US005161643A

United States Patent [19]

Ampferer

[11] Patent Number: 5,161,643

[45] Date of Patent: Nov. 10, 1992

[54] DELAY PART FOR LUBRICATING OIL

[75] Inventor: Herbert Ampferer, Sachsenheim, Fed. Rep. of Germany

[73] Assignee: Dr. Ing. h.c.F. Porsche AG, Fed. Rep. of Germany

[21] Appl. No.: 642,540

[22] Filed: Jan. 17, 1991

[30] Foreign Application Priority Data

Jan. 19, 1990 [DE] Fed. Rep. of Germany ..... 4001467

[51] Int. Cl.[5] ..... F01M 1/04

[52] U.S. Cl. ..... 184/6.5; 123/195 C; 123/196 R; 184/106

[58] Field of Search ..... 184/6.5, 6.23, 106; 123/196 R, 195 C

[56] References Cited

U.S. PATENT DOCUMENTS

| | | | |
|---|---|---|---|
| 1,256,754 | 2/1918 | White | 184/6.5 |
| 1,662,963 | 3/1928 | Eastman . | |
| 1,871,760 | 8/1932 | Taub | 184/6.5 |
| 1,892,185 | 12/1932 | Clements | 184/106 |
| 3,100,028 | 8/1963 | Booth et al. | 184/106 |
| 3,106,263 | 10/1963 | McKellar | 123/196 R |
| 3,653,464 | 4/1972 | Jacobsen et al. | 184/6.5 |
| 3,695,386 | 10/1972 | Thien et al. | 123/195 C |
| 4,394,853 | 7/1983 | Lopez-Crevillen et al. | 184/106 |
| 4,519,348 | 5/1985 | Hamilton | 123/196 R |
| 4,616,609 | 10/1986 | Münch et al. | 123/196 R |
| 4,898,261 | 2/1990 | Winberg et al. | 123/195 C |

FOREIGN PATENT DOCUMENTS

| | | | |
|---|---|---|---|
| 0166698 | 1/1987 | European Pat. Off. . | |
| 3531352 | 9/1985 | Fed. Rep. of Germany . | |
| 2431651 | 2/1980 | France | 123/195 C |
| 2230296 | 10/1990 | United Kingdom | 123/195 C |

OTHER PUBLICATIONS

ATZ Automobiltechnische Zeitschrift 89 (1987) 2, p. 69.

*Primary Examiner*—Ira S. Lazarus
*Assistant Examiner*—Alan B. Cariaso
*Attorney, Agent, or Firm*—Evenson, Wands, Edwards, Lenahan & McKeown

[57] ABSTRACT

A delay part for lubricating oil is arranged in the power section of an internal-combustion engine adjacent to a or in an area bordering on the oil pan. The part prevents the immediate intake of foamed oil in that it has oil passages along its boundary but otherwise separates the spaces situated above and below the delay apparatus from one another. The oil reaches the strainer in a time-delayed manner and is therefore effectively degassed.

7 Claims, 2 Drawing Sheets

DELAY PART FOR LUBRICATING OIL

BACKGROUND AND SUMMARY OF THE INVENTION

The present invention relates to a lubricating oil delay part, and, more particularly, to a delay part for an internal combustion engine having a cylinder block, crankcase and a divided oil pan held on the crankcase.

Oil baffles are known for example, from the journal *ATZ* 89 (1987) 2, Page 69, for acting as so-called oil planing devices and arranged between the cylinder block and the oil pan. These oil baffles have the purpose of reducing the foaming of the oil, particularly at high rotational speeds.

In the German Patent DE-35 31 352 C1, a honeycombed insert in the recess of an oil pan surrounds the suction pipe of the oil pump and, through its chambers, the oil reaches the suction pipe in a time-delayed manner and, as a result, defoamed. This type of an arrangement cannot be used if there is insufficient installation space available in the recess.

It is an object of the present invention to largely defoam the foamed oil in an internal-combustion engine.

This object has been achieved in accordance with the present invention by extending a delay part in a horizontal area situated in a plane to border the oil pan. A space situated above the delay part by way of oil passages arranged adjacent to an outer boundary is connected with a space situated underneath.

The delay part arrangement prevents a short-circuit-type intake of foamed oil. When the delay part is arranged adjacent to a surface provided with sealing devices between the crankcase and the oil pan, the foamed oil dripping out of the crank space must first flow on the delay part to its boundary and through the oil passages arranged there and must flow back under the delay part to the centrally arranged strainer. The resulting forced time delay until the intake causes a good defoaming of the oil.

The same advantage is achieved in the case of an arrangement of the delay part adjacent to an area provided with sealing devices which is part of a horizontally divided oil pan between the deep part of the oil pan used as the storage tank and the lid which closes it on the bottom. The oil which flows back into the storage tank approximately in the center from the crankcase must cover the above-mentioned delay path to the strainer situated in the oil pump between the delay part and the lid.

In an advantageous embodiment of the invention, the delay part is held on an oil pump and extends close to the inner edge of the area provided with the sealing devices. For the fastening, the delay part has an opening into which the strainer is fitted and the edge area of which is detachably connected with a flange of the oil pump.

In a further embodiment, the boundary has a flange-shaped configuration and is braced in the area. Advantageously, a sealing device which acts on both sides may be integrated into the boundary so that the normal separate sealing devices are not required. In the range of the screwed connection between the parts bordering on the area, spacer sleeves are integrated into the sealing device so that a pressure exists which is uniform over the entire circumference and prevents a crushing of the sealing device.

The delay part may be simply produced as a stamped sheet metal part or as a molded plastic part. Subsequently, the sealing device is vulcanized on, together with the spacer sleeves, as elastomers. In the case of a plastic construction, ribs which extend from the direction of the boundary toward the opening for the strainer may easily be arranged on the underside of the delay part facing the oil sump. In the case of accelerations, these ribs force the oil situated in the sump along the strainer.

It is also advantageous for the oil situated below the delay part, in the case of strong accelerations, to displace itself considerably less than the part of the lubricating oil quantity situated above because the oil from the oil sump can move to the top only comparatively slowly by way of the oil passages. This ensures a constant flow around the strainer.

BRIEF DESCRIPTION OF THE DRAWINGS

These and other objects, features and advantages of the present invention will become more apparent from the following detailed description of a presently preferred embodiment when taken in conjunction with the accompanying drawings wherein.

DETAILED DESCRIPTION OF THE DRAWINGS

Figure 1:
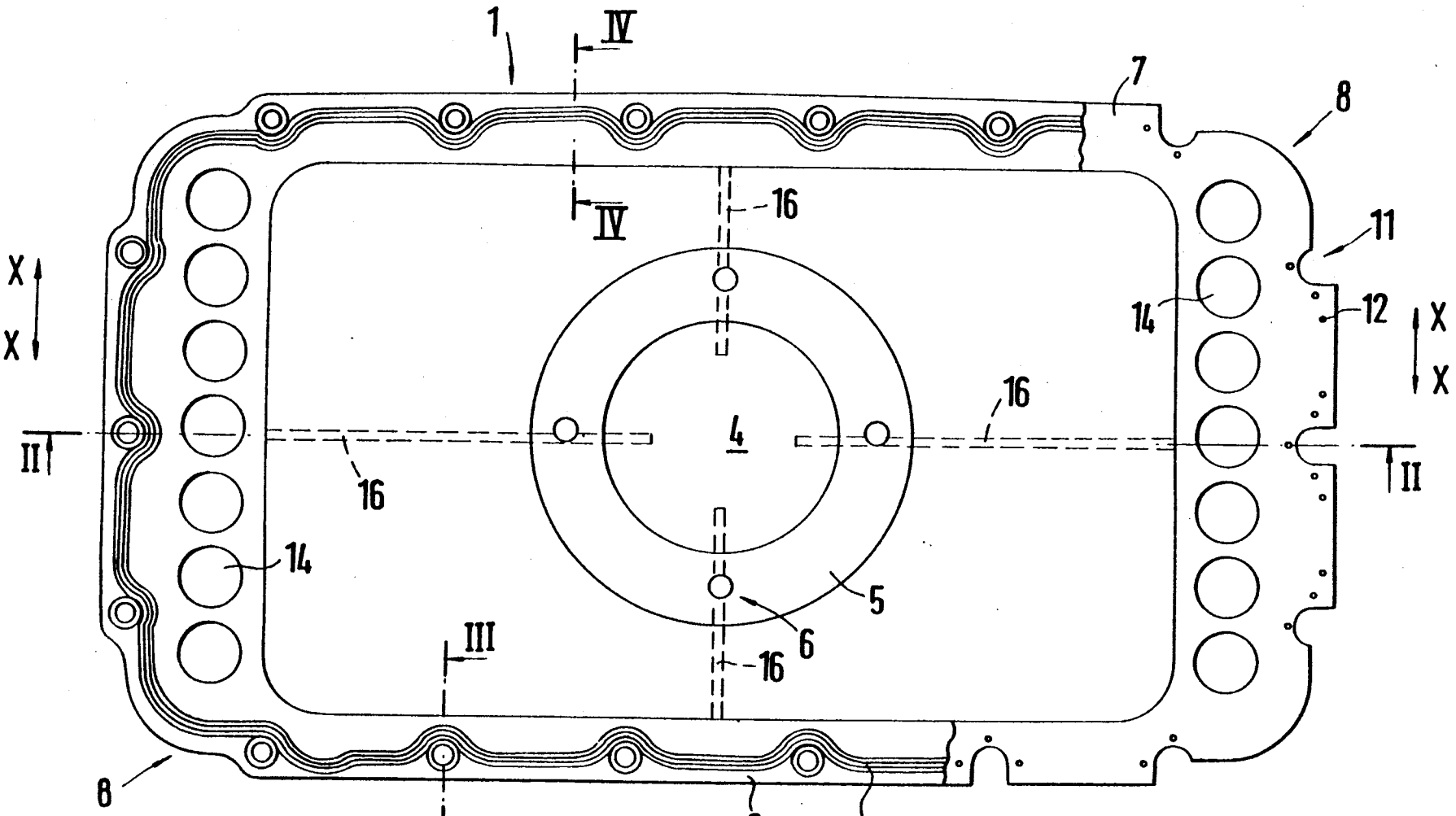
FIG. 1 is a top view of a delay part shown partly unmachined.

A delay part 1 extends in a plane E1 in the power section (not shown in detail) of a motor vehicle internal-combustion engine. This plane E1 (FIG. 2) includes an area F between the deep part of an oil plan acting as the storage tank V for the lubricating oil and a lid 2 closing off this container toward the bottom. An oil pump 3 which is only outlined is arranged in the storage tank V above the delay part 1. In a center portion of the approximately rectangular delay part 1, an opening 4 is provided and has an edge area 5 connected with a flange of the oil pump by screwed connections 6.

The delay part 1 comprises a stamped unmachined part 7 shown in the right side of FIG. 1, and a sealing device 9 acting on both sides is mounted on the outer flange-shaped boundary 8 of the stamped unmachined part 7. The sealing device 9 encloses the boundary 8 in a U-shape and has sealing lips 10. Inwardly directed recesses 11 are arranged on the boundary 8 of the unmachined part 7, and small openings 12 penetrating the delay part 1 adjacent to the recesses 11. The recesses 11 receive spacer sleeves 13 embedded in the sealing device 9. Screwing of the lid 2 to the storage tank V takes place through these spacer sleeves 13, and at the same time, a bracing of the delay part 1 in the area F. Several oil passages 14 are arranged along the parts of the boundary 8 situated in the driving direction X—X of the motor vehicle.

During the operation of the internal-combustion engine, the foamed lubricating oil flowing back from the crankcase enters the storage tank V by way of an inlet situated almost in the center above the opening 4. In order to reach the strainer 15 in the oil sump S which is situated below the delay part 1 and is fitted from above through the opening 4, the lubricating oil will necessarily flow from the inlet to the oil passages 14 and from there back to the strainer 15. The oil is almost completely degassed along this delay path.

The oil sump S has a low overall height so that only a small amount of oil remains between the lid 2 and the delay part 1. During the normal driving operation, the remaining amount of oil is situated above plane E1, and therefore also the level. Foamed oil flowing freshly into the storage tank V must fall from the oil level to the proximity of the delay part 1, resulting in additional time for degassing.

Figure 2:
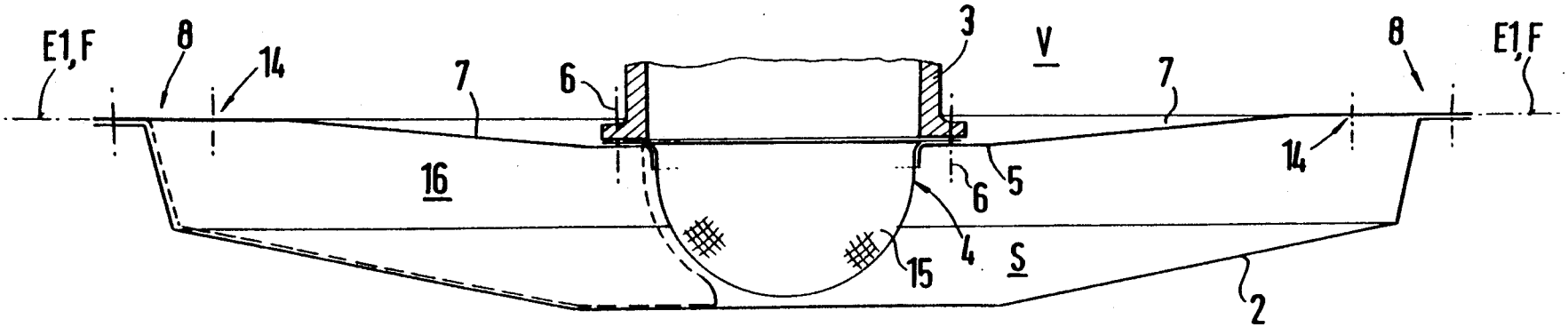
FIG. 2 is a sectional view of the unmachined portion along Line II—II of to FIG. 1.
Figure 4:
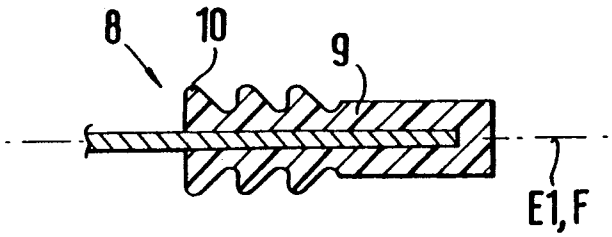
FIG. 4 is a sectional view along Line IV—IV of FIG. 1.
Figure 3:
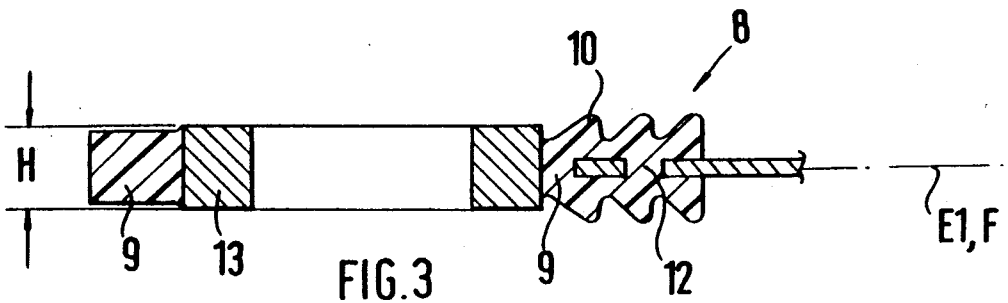
FIG. 3 is a sectional view along Line III≧III of FIG. 1.

When the unmachined part 7 is constructed as a molded plastic part, ribs 16 may be arranged on the underside of the delay part 1 facing the oil sump S, as indicated by the dashed lines in FIGS. 1 and 2. These ribs 16 extend from the boundary 8 in the direction of the opening 4 and, during accelerations, guide the oil in a forced or positive manner along the strainer 15.

During manufacture of the delay part, the unmachined part 7, as a stamped part, is manufactured first, in one operation with the opening 4, the recesses 11, the oil passages 14 as well as the openings 12. Subsequently, the sealing device is sprayed or otherwise deposited in a known manner around the boundary 8 while the spacer sleeves are integrated into the sealing device 9 at the same time. During the spraying or depositing operation, the material of the sealing device 9 penetrates the openings 12 so that they are secured with respect to moving off-center.

When the lid 2 is mounted on the storage tank V, the height H of the spacer sleeves 13 limits compressions of the sealing lips 10 to an extent which ensures a reliable sealing on both sides and prevents a crushing of the sealing device 9.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A delay apparatus for lubricating oil in an internal-combustion engine having a cylinder block and crankcase with an oil pan held thereon, comprising a delay part extending in a horizontal area situated in a plane and bordering the oil pan and having an opening with a ring-type edge area detachable connected with an oil pump of the engine, wherein a space situated above the delay part is connected with a space situated underneath the delay part only via oil passages arranged adjacent to an outer boundary of the part, which outer boundary has a flange and is braced on the horizontal area, and a surrounding sealing device is arranged in the outer boundary, and inwardly directed recesses for receiving spacer sleeves are integrated into the sealing device and are arranged in the outer boundary.

2. The delay apparatus according to claim 1, wherein the oil pan is divided.

3. The delay apparatus according to claim 1, wherein the sealing device surrounds the outer boundary in a U-shaped manner.

4. The delay apparatus according to claim 1, wherein ribs extend on a side of the delay part from the outer boundary in the direction of the opening.

5. The delay apparatus according to claim 4, wherein the sealing device surrounds the outer boundary in a U-shaped manner.

6. The delay apparatus according to claim 1, wherein the sealing device has sealing lips extending perpendicular to the plane which, in the area of the inwardly directed recesses, extend around the spacer sleeves on one side thereof.

7. The delay apparatus according to claim 6, wherein ribs extend on a side of the delay part from the outer boundary in the direction of the opening.

* * * * *